US009986817B1

(12) United States Patent
Wesley

(10) Patent No.: US 9,986,817 B1
(45) Date of Patent: Jun. 5, 2018

(54) PRECISION BRUSH

(71) Applicant: Stephen D. Wesley, Louisville, KY (US)

(72) Inventor: Stephen D. Wesley, Louisville, KY (US)

( * ) Notice: Subject to any disclaimer, the term of this patent is extended or adjusted under 35 U.S.C. 154(b) by 16 days.

(21) Appl. No.: 15/097,866

(22) Filed: Apr. 13, 2016

(51) Int. Cl.
*A46B 9/02* (2006.01)

(52) U.S. Cl.
CPC ..... *A46B 9/026* (2013.01); *A46B 2200/202* (2013.01)

(58) Field of Classification Search
CPC ... A46B 2200/202; A46B 9/026; A46B 9/028; A46B 3/12
See application file for complete search history.

(56) References Cited

U.S. PATENT DOCUMENTS 4,483,036 A 11/1984 Sayklay
4,590,637 A * 5/1986 Marino ..... A46B 9/02 15/160
4,791,695 A * 12/1988 Kephart ..... A46B 9/02 101/372
4,821,361 A * 4/1989 Meimeteas ..... A46B 17/00 15/168
4,998,315 A 3/1991 Pessis
5,507,063 A 4/1996 Hirsch
7,895,698 B2 3/2011 Mink
7,950,402 B1 5/2011 Cole
2014/0166041 A1 6/2014 King
2014/0366298 A1 * 12/2014 Cox ..... A46B 3/02 15/193

* cited by examiner

*Primary Examiner* — Laura C Guidotti
(74) *Attorney, Agent, or Firm* — Tuggle Duggins P.A.; Blake Hurt

(57) ABSTRACT

A precision paint brush formed from an arcuate ferrule attached to a handle and carrying a number of filaments oriented into a complementary arch shape for accurate and efficient administration of liquids such as paint is provided. By creating an apex within the application surface as formed by the arched filaments, the brush produces a more focused application surface area, particularly useful in situations such as painting a wall in close proximity to the ceiling, as pressure by the user into the substrate compels the filaments to spread out without exceeding the defined apex area.

5 Claims, 4 Drawing Sheets

PRECISION BRUSH

FIELD OF THE INVENTION

The invention herein pertains to a brush and particularly pertains to a modified brush for more precisely applying a fluid such as paint to a substrate.

DESCRIPTION OF THE PRIOR ART AND OBJECTIVES OF THE INVENTION

Brushes made with natural and/or synthetic bristles are used for a variety of activities involving the application of various products and substances. Specially designed brushes may be employed where specific control is needed during application of, for example, artistic materials used in creating works of fine art. There are numerous cosmetic and artistic substances and materials provided in an array of forms designed for application to various surfaces, such as the skin, as well as a variety of permeable and non-permeable surfaces such as paper, canvas, wood, ceramics, plastics, etc. Regardless of the form of a cosmetic/art material, e.g., whether in liquid, semi-liquid or solid forms, a primary objective involves achieving application of the desired product(s) in a specific amount, shape, at a particular location, etc. In particular, application of the product in a specific manner becomes critical when a certain effect is desired, for example when painting on a first substrate without intending to paint on a second substrate (sometimes referred to as "edging" or "cutting in"). Brushes having specialized structure for facilitating certain applicator effects have been introduced. Such brushes may include pillared bristles for use with a stencil mask as a fabric paintbrush or as an artist's paintbrush or angular tips to facilitate various artistic and coverage effects and designs. However, the issues with these otherwise "specialized" brushes is that they are often ineffective at painting larger, less confined spaces with equal ease.

Thus, in view of the problems and disadvantages associated with prior art brushes, the present invention was conceived and one of its objectives is to provide a brush with an arcuate ferrule attached to a handle.

It is another objective of the present invention to provide a brush with an arcuate ferrule that receives a plurality of filaments defining the same length.

It is still another objective of the present invention to provide a brush with an arcuate ferrule that receives a plurality of filaments defining different lengths.

It is yet another objective of the present invention to provide a brush with an arcuate ferrule that receives a plurality of filaments and orients them in a configuration that defines an angular bias.

It is a further objective of the present invention to provide a brush with an arcuate ferrule holding a plurality of filaments with respective distal ends that are blunt cut.

It is still a further objective of the present invention to provide a brush with an arcuate ferrule holding a plurality of filaments that define one or more different lengths, producing an overall filament pattern that is generally wedge shaped.

It is yet a further objective of the present invention to provide a brush with an arcuate ferrule and a plurality of filaments oriented in an arch that is efficient to manufacture and simple to use.

It is still yet another objective of the present invention to provide a brush with an arcuate handle and arcuate ferrule that receive a plurality of filaments and orients them in an orientation that defines an angularly biased wedge shape.

Various other objectives and advantages of the present invention will become apparent to those skilled in the art as a more detailed description is set forth below.

SUMMARY OF THE INVENTION

The aforesaid and other objectives are realized by providing a brush of the type typically used in painting interior or exterior walls that seeks to improve application precision of a liquid to a substrate by defining a ferrule with a significant arch or arcuate shape. The application surface, usually defined by a plurality of filaments attached to the ferrule and thus defines the same arcuate shape, has an application surface with a curve defining an apex. By creating an apex within the application surface, the brush produces a more focused application surface area, particularly useful in situations such as painting a wall in close proximity to the ceiling, as pressure by the user into the substrate compels the filaments to spread out without exceeding the defined apex area.

DETAILED DESCRIPTION OF THE PREFERRED EMBODIMENT AND OPERATION OF THE INVENTION

Figure 4:
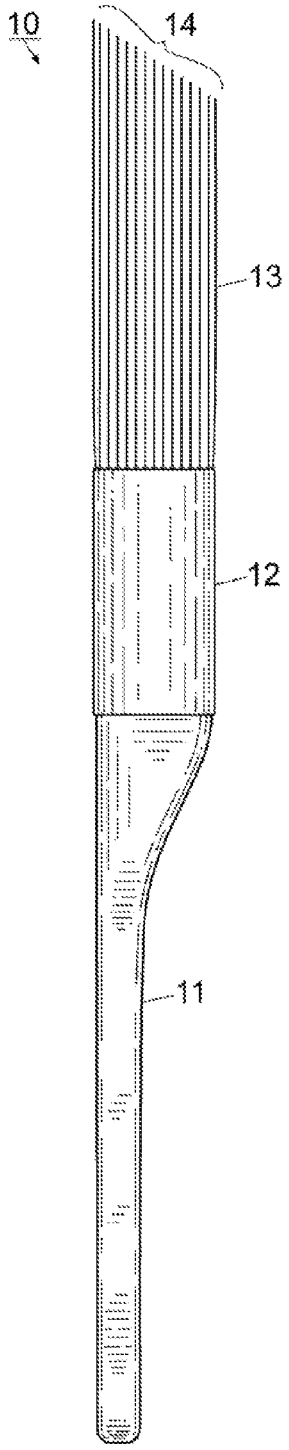
FIG. 4 depicts an elevated side view of the brush of FIG. 1, the opposite side view being identical thereto.
Figure 5:
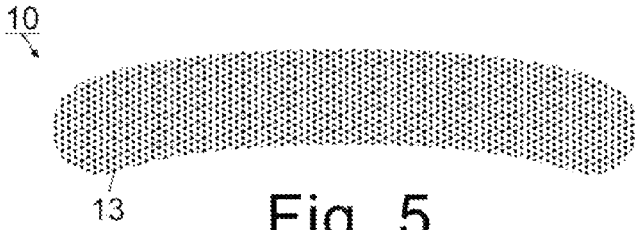
FIG. 5 demonstrates an elevated top plan view of the brush of FIG. 1.

For a better understanding of the invention and its operation, turning now to the drawings, FIGS. 1-6 display various views of preferred precision brush 10, formed from handle 11 mounted to arcuate ferrule 12 that carries one or more filaments 13 which define application surface 14 (FIG. 4). As would be understood, handle 11 is affixed to ferrule 12, for example with adhesive, mechanical fasteners (not shown), or the like. Ferrule 12 may be formed from any appropriate material as is known in the art, but preferred ferrule 12 is formed from wood or a metal material in the nature of a band or crimp about one terminal end of handle 11. Similarly, handle 11 may define any length and may be formed from any appropriate material as is known in the art, but preferred handle 11 is formed from wood or a polymeric material. The shape of handle 11 is not intended to be limited, but an ergonomically advantageous design as illustrated in FIGS. 1, 2, 4, and 6 is preferred.

Figure 6:
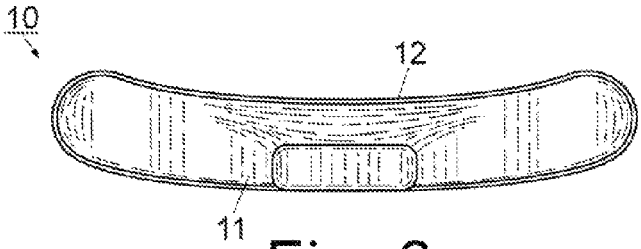
FIG. 6 demonstrates an elevated bottom plan view of the brush of FIG. 1.

Ferrule 12 preferably defines an arcuate, convex shape instead of the rectangular or ovular shape common in the prior art. The end of handle 11 oriented proximate ferrule 12 may define a complimentary arcuate shape to that of ferrule 12 such as seen in FIG. 6, but for ease of manufacturing and assembly, embodiments of handle 11 may also define a conventional (i.e. circular or rectangular) shape consistent with known, non-arcuate ferrule shapes. Ferrule 12 may define any length consistent with the desired size of brush 10, but preferably defines a width between three inches and four and a half inches (7.62 cm-11.43 cm). The convex nature of ferrule 12 is preferably described as a portion of a circle (i.e. an arch) derived from a circle defining nine and a half inches (24.13 cm) in diameter, and is best shown in FIG. 6.

Figure 1:
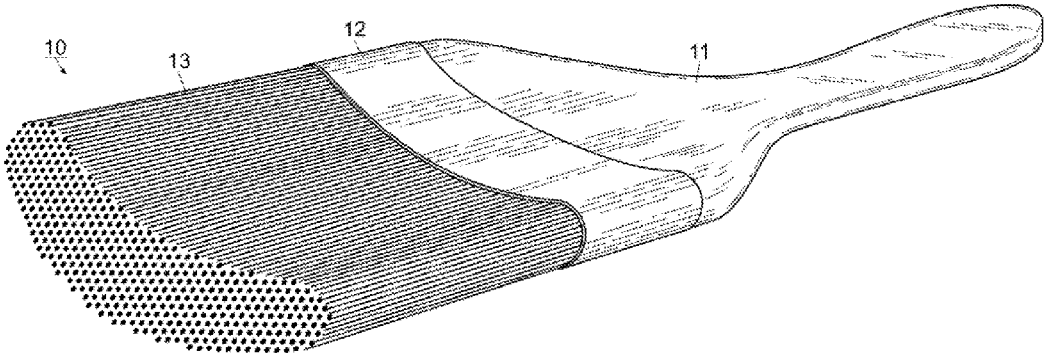
FIG. 1 shows an elevated perspective view of a precision brush proximate a substrate.
Figure 2:
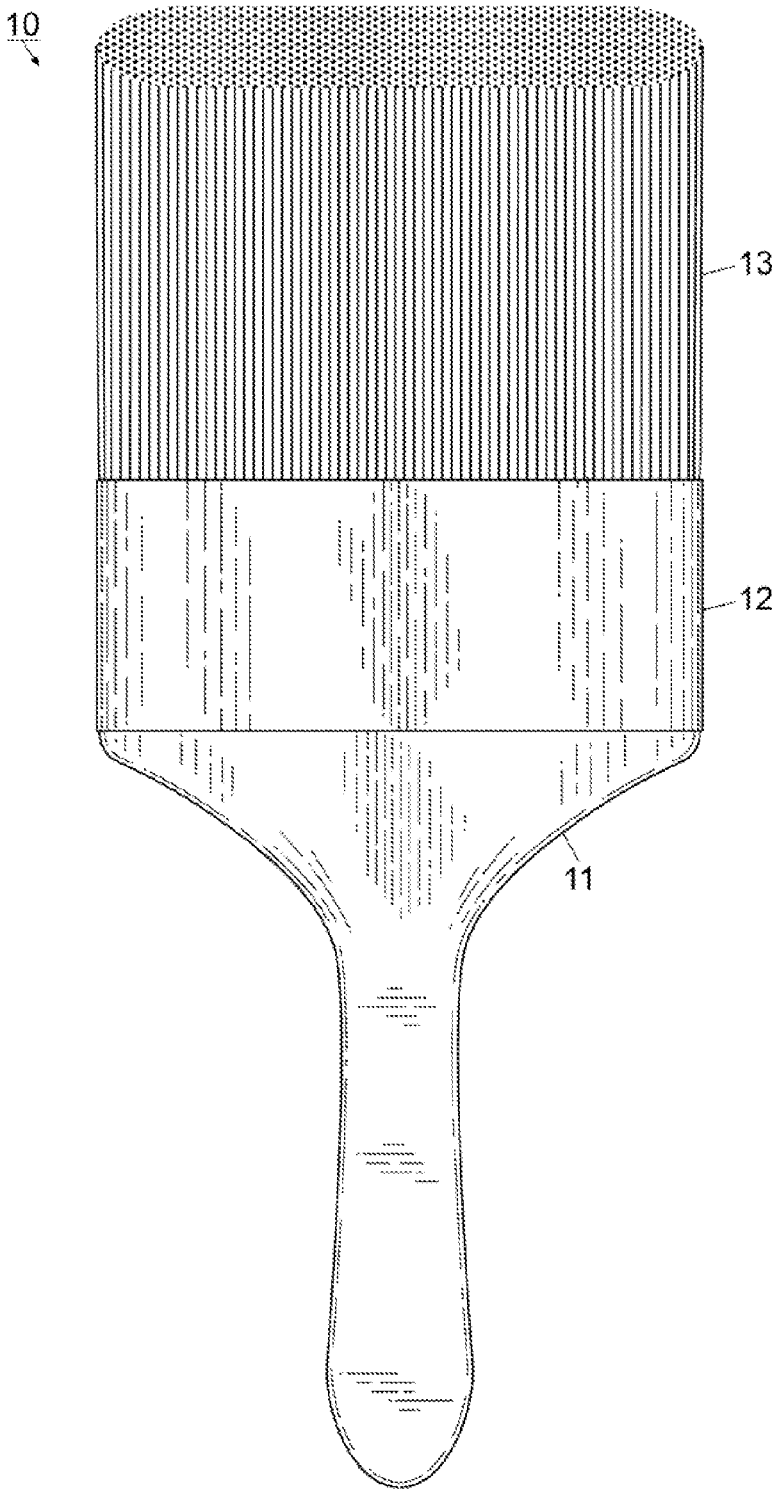
FIG. 2 pictures an elevated front plan view of the brush of FIG. 1.
Figure 3:
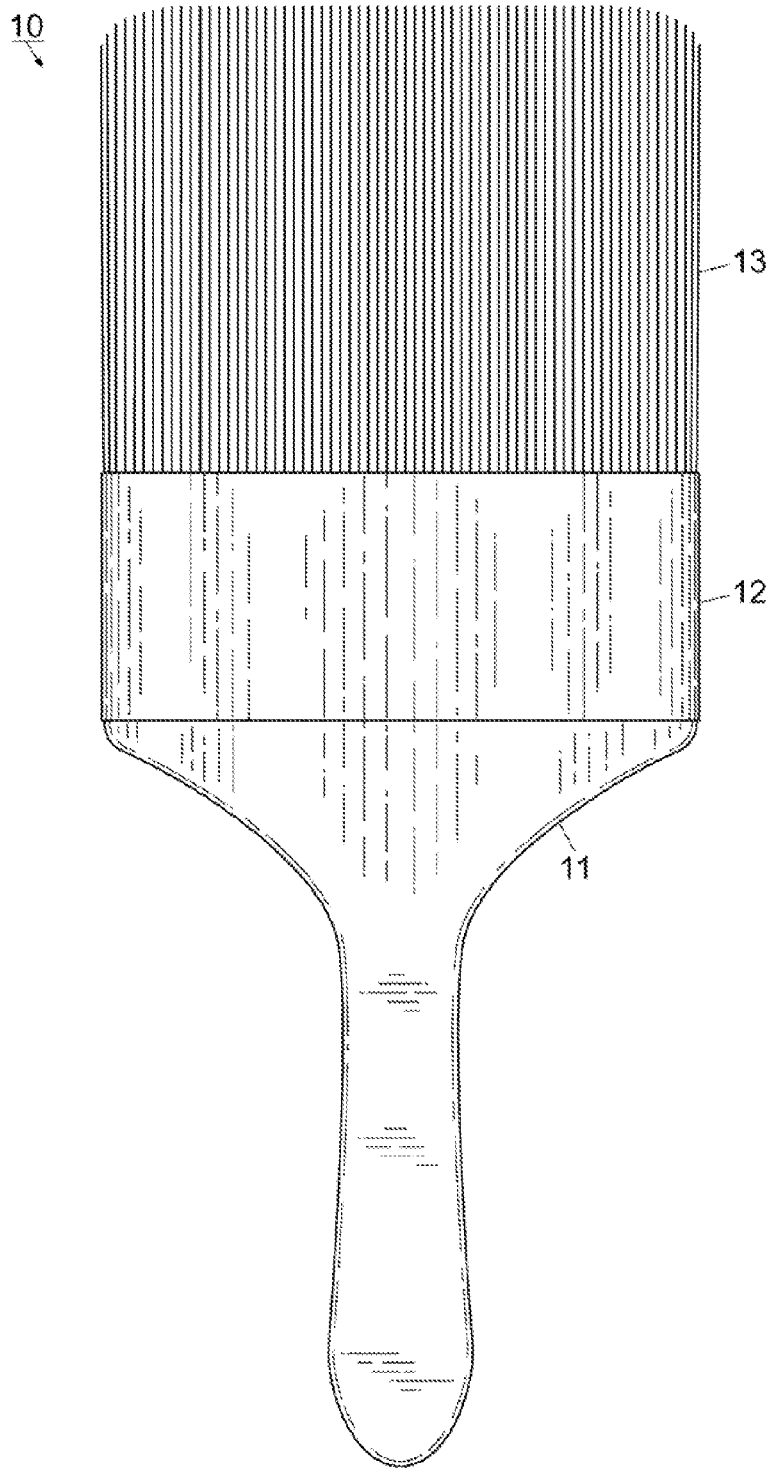
FIG. 3 pictures an elevated rear plan view of the brush of FIG. 1.

As demonstrated throughout FIGS. 1-6, filaments 13 each define a generally cylindrical shape and may be formed from any material, although preferred embodiments of filaments 13 are formed from nylon, natural bristle, or polymer and/or synthetic blends. By virtue of attachment to arcuate ferrule 12, one or more filaments 13 combine to define a complementary arcuate shape (i.e. substantially the same as that of ferrule 12), preferably approximately five degrees (5°) or less relative to the center of the arch defined by filaments 13, positioning the filaments at the perimeter slightly lower relative to the horizon than the filaments in the middle. Filaments 13 are preferably blunt cut (that is to say, vertical at the distal end) at the distal terminal ends or "tips" to facilitate even transfer of a given liquid to a substrate but alternative embodiments of filaments 13 may define an angular bias at a terminal end distal to ferrule 12. Alternatively, or in addition, filaments 13 may be oriented such that a grouping of filaments 13 define a length longer than one or more other groups of filaments 13, producing an overall bristle shape which defines a somewhat wedge shape. The respective collections of filaments 13 define an angular bias between twenty and ninety degrees (20°-90°) and preferably defines an angle between sixty and eighty degrees (60θ-80°). In one or more alternate embodiments, various types of filaments 13 may be utilized in forming brush 10 such as bristles formed from natural hairs or synthetic fibers, for example polyester, rayon, nylon, or the like and may include split, frayed, biased, pointed or other style tips. During assembly of the filaments to the handle (although not shown) the filaments may be of the same length, whereby the handle and/or ferrule rather than have a flat top surface for attachment of the filaments, could be tapered to define an angle such as seen by the angle of application surface 14 to allow filaments 13 when affixed thereto, although being of the same length, to define the same complementary shape of application surface 14 as seen in FIGS. 1, 2, and 4. Attaching the bristles to complement the curved shape of the handle and/or ferrule provides for a brush with greater precision and visibility as the point of control is reduced to a smaller area such that the brush spreads a more precise, even layer of paint to the desired surface when in use, and should not be considered merely a design choice.

In use, brush 10 is assembled with one or more filaments 13 affixed to arcuate ferrule 12 that is carried by handle 11. The somewhat C shape defined by ferrule 12 produces a collection of filaments 13 that are oriented lower at the outboard, distal edges and higher at an inboard, proximal midpoint referred to as the apex (i.e. about the center of the curve cooperatively defined by ferrule 12 and filaments 13). Additionally, filaments 13 may be oriented such that one grouping of filaments defines a longer length than one or more other groupings of filaments 13, as a group defining an angular bias that would generally relate to a parallel relationship relative to a substrate when brush 10 is held by a user (not shown). The arcuate shape defined by ferrule 12 and filaments 13 bestow upon brush 10 its ability to precisely distribute liquid to a substrate. Specifically, the liquid application area proximate the apex of the arch produces an area of unexpectedly superior control relative to the prior art, whereby the user may successfully spread a liquid such as paint along a linear barrier, such as for example along a window or door casing, in a controlled, even manner. This control is maintained even as filaments 13 are compressed, and thus spread out, when pressed into a substrate as would be understood during use of brush 10.

Although not shown in the figures, a porous, non-filament liquid applicator configured with a complementary shape to that of arcuate ferrule 12 and defining the same characteristics as the collection of filaments 13 described above may serve the same purpose as the present invention. As such, a non-filament applicator, for example formed from foam, sponge, or the like should be construed as within the scope of the instant disclosure.

The illustrations and examples provided herein are for explanatory purposes and are not intended to limit the scope of the appended claims.

I claim:

1. A brush comprising an arcuate ferrule defining a width of between three inches and four and a half inches and arching in a uniform and symmetrical geometry from a first side of the ferrule to a second, opposing side of the ferrule and affixed to a handle, the handle defining a terminal end proximate to and abutting with the ferrule with the terminal end defining a complimentary arcuate shape relative to the ferrule, the ferrule carrying a plurality of filaments with each filament defining a proximal end that has been blunt cut, the plurality of filaments defining a convex arcuate shape complimentary to the ferrule and divided into two or more groups, the first group of filaments defining a first length, the second group of filaments defining a second length, the second length less than that of the first length forming an application surface with a wedge shape defining a continuously angular bias, whereby the plurality of filaments define an arch shape complementary to the arcuate ferrule with portions of the filaments oriented approximately five degrees lower proximate the ferrule first and second sides relative to a portion of the filaments proximal an apex, and whereby the angular bias of the wedge shape is defined by an angle between sixty and eighty degrees.

2. The brush of claim 1, whereby the handle is formed from wood.

3. The brush of claim 1, whereby the handle is formed from a polymer material.

4. The brush of claim 1, whereby the ferrule is formed from metal.

5. The brush of claim 1, whereby the ferrule is formed from a polymer material.

* * * * *